US012053814B2

(12) United States Patent
Zhang et al.

(10) Patent No.: US 12,053,814 B2
(45) Date of Patent: Aug. 6, 2024

(54) METHOD FOR MAKING PROFILE WITH MICRO-HOLE

(71) Applicant: SHANDONG UNIVERSITY, Shandong (CN)

(72) Inventors: Cunsheng Zhang, Shandong (CN); Mingfu Liu, Shandong (CN); Guoqun Zhao, Shandong (CN); Liang Chen, Shandong (CN); Xinwu Ma, Shandong (CN)

(73) Assignee: SHANDONG UNIVERSITY, Shandong (CN)

( * ) Notice: Subject to any disclaimer, the term of this patent is extended or adjusted under 35 U.S.C. 154(b) by 723 days.

(21) Appl. No.: 17/045,645

(22) PCT Filed: Sep. 10, 2019

(86) PCT No.: PCT/CN2019/105145

§ 371 (c)(1),
(2) Date: Oct. 6, 2020

(87) PCT Pub. No.: WO2020/052552

PCT Pub. Date: Mar. 19, 2020

(65) Prior Publication Data

US 2021/0187582 A1 Jun. 24, 2021

(30) Foreign Application Priority Data

Sep. 11, 2018 (CN) ..... 201811055752.2

(51) Int. Cl.

| | |
|---|---|
| ***B21D 43/00*** | (2006.01) |
| ***B21C 23/04*** | (2006.01) |
| ***B21C 35/02*** | (2006.01) |
| ***B21D 28/24*** | (2006.01) |
| *B21C 25/02* | (2006.01) |

(52) U.S. Cl.

CPC ..... *B21D 28/243* (2013.01); *B21C 23/04* (2013.01); *B21C 35/023* (2013.01); *B21C 25/02* (2013.01); *B21D 43/003* (2013.01)

(58) Field of Classification Search

CPC .... B21D 28/243; B21D 43/003; B21C 23/04; B21C 35/023; B21C 25/02

See application file for complete search history.

(56) References Cited

FOREIGN PATENT DOCUMENTS

| | | |
|---|---|---|
| CN | 1850383 | 10/2006 |
| CN | 105478683 | 4/2016 |
| CN | 107031006 | 8/2017 |
| CN | 108118417 | 6/2018 |
| CN | 109248935 | 1/2019 |
| JP | H01233407 | 9/1989 |

OTHER PUBLICATIONS

Machine Translation of CN107031006A by Li Shengui et al. "Machining Method of Micropore Catheter". Aug. 11, 2017 (Year: 2017).*

* cited by examiner

*Primary Examiner* — Nirvana Deonauth
(74) *Attorney, Agent, or Firm* — DLA PIPER LLP (US)

(57) ABSTRACT

A method for making a profile with a micro-hole, in particular using a continuous composite extrusion process, comprises embedding, in a position in a matrix of the profile to be formed where a micro-hole is to be formed, a continuous wire having a shape and size consistent with that of the micro-hole; sawing a composite profile with the wire obtained by extrusion to a desired length; and removing the wire from the sawed composite profile using a predetermined physical or chemical method without changing the matrix of the composite profile so that the micro-hole of the predetermined size and shape is formed in the predetermined position in the profile. This method is simple, does not require any large, expensive, and sophisticated equipment, can produce continuous micro-holes of different specifications, and can be used in a wide variety of applications.

7 Claims, No Drawings

METHOD FOR MAKING PROFILE WITH MICRO-HOLE

CROSS-REFERENCE TO RELATED APPLICATIONS

This application is a § 371 national phase entry of International Application No. PCT/CN2019/105145, filed Sep. 10, 2019, which claims priority to Chinese Patent Application No. 201811055752.2, filed Sep. 11, 2018.

FIELD OF THE INVENTION

The present invention is related to the field of micro-hole machining/forming, and in particular to a method for making a profile with a micro-hole.

BACKGROUND OF THE INVENTION

Various components with micro-holes are used in a wide variety of applications including aerospace, vehicle machinery, and optoelectronic instruments. Methods for machining or forming deep micro-holes in a profile are limited.

CN 104785811 A describes a method for machining micro-holes comprising performing drilling from both sides by means of a drill bit, which can solve problems that occur with micro-pin jig drilling, such as tool breaking, hole deflection and severe hole blockage, and can enable batch machining of micro-holes, reduced manufacturing costs, and improved productivity and workpiece quality. However, it is difficult to form deep micro-holes with hole sizes of less than 3 millimetres using this method due to the fact that the method is still conventional and turning, milling and drilling operations thereof and the like are restricted by tools. Further, it is difficult to remarkably improve the productivity by using the method.

CN 107030401 A describes a device for machining micro-holes, comprising a laser beam collimating module, a beam expanding module, a beam shaping module, and a laser focusing template. The laser beam collimating module is configured for collimation of a laser beam. The beam expanding module is configured for increasing the size of an input laser beam from a small diameter to a larger diameter. The beam shaping module is provided on a light exit side of the beam expanding module, and configured for regulating the light intensity distribution of the incident light. The laser focusing template is provided on a light exit side of the beam shaping module, and comprises a plate and a plurality of microlenses arranged on the plate. The plate is configured for preventing transmission of the incident light thereon. The microlenses allow transmission and focus of the incident light thereon, and the plane in which a plurality of focuses of the incident light focused by the plurality of microlenses lie conforms to the shape of a surface to be machined of a workpiece. The device is able to form a plurality of micro-holes at one time, substantially improving the efficiency of laser machining. The machining method performed using the device is a non-traditional machining method, which further comprises wire cutting, spark machining, and the like. Such a machining method requires sophisticated and expensive equipment, and may be limited by machine tools, accuracy of the method itself, depths of the micro-holes, cross section sizes, and machining accuracy. Moreover, it is difficult to form deep micro-holes with smaller hole sizes using such a method. Therefore, in view of the above, there is a need in the art for a new method for forming micro-holes in profiles.

SUMMARY OF THE INVENTION

To address the above-discussed deficiencies of the prior art, the present invention provides a method for making a profile with a micro-hole, in particular using a continuous composite extrusion process, comprising embedding, in a position in a matrix of the profile to be formed where a micro-hole is to be formed, a continuous wire having a shape and size consistent with that of the micro-hole; sawing a composite profile with the wire obtained by the extrusion process to a desired length; and removing the wire from the sawed composite profile using a predetermined physical or chemical method without changing the matrix of the composite profile so that the micro-hole of the predetermined size and shape is formed in the predetermined position in the profile. The method of the invention is simple, does not require any large, expensive, and sophisticated equipment, and has a good prospect of industrial application.

One objective of the invention is to provide a method for making a profile with a micro-hole.

Another objective of the invention is to provide a profile made by the above-described method.

A further objective of the invention is to provide a use of the above-described profile.

A first aspect of the present invention is a method for making a profile with a micro-hole, comprising embedding, in a position in a matrix of the profile to be formed by a continuous composite extrusion process where a micro-hole is to be formed, a continuous wire having a shape and size consistent with that of the micro-hole; performing extrusion to obtain a composite profile with the wire; and removing the wire from the obtained composite profile without changing the matrix thereof using a method which is performed based on a difference in physical or chemical properties between the wire and the matrix of the composite profile to obtain the profile with the micro-hole.

In particular, the method may comprise steps of:

i. performing a continuous composite extrusion process by using a composite extrusion die to form a composite profile, wherein, in a position in a matrix of the profile to be formed where a micro-hole is to be formed, a continuous wire having a shape and size consistent with that of the micro-hole is embedded; and ii. cutting the composite profile to a desired length; and removing the wire from the cut composite profile without changing the matrix thereof using a method which is performed based on a difference in physical or chemical properties between the wire and the matrix of the composite profile to obtain the profile with the micro-hole.

In an embodiment of the invention, the profile to be formed is a titanium alloy profile, and the wire is a composite of glass fibre and nickel, or glass fibre and steel, or glass fibre and copper.

In this embodiment, the titanium alloy composite profile is heated to soften the glass fibre therein and separate it from the matrix of the composite profile so that the nickel, steel, or copper wire is removed from the composite profile and thus a micro-hole of a predetermined size and shape is formed in a predetermined position in the profile. This embodiment of the invention is based on the fact that the melting point of the titanium alloy profile is substantially greater than the softening point of the glass fibre in the glass fibre-nickel/steel/copper composite.

The glass fibre-nickel composite is preferably glass fibre wrapped nickel wire. Similarly, the glass fibre-steel composite is preferably glass fibre wrapped steel wire, and the glass fibre-copper composite is preferably glass fibre wrapped copper wire.

In the embodiment as described above, the composite profile is heated to a temperature which is equal to or higher than the softening point of the glass fibre and lower than the melting point of the titanium alloy.

In another embodiment of the invention, the profile to be formed is an aluminium alloy profile, and the wire is a magnesium wire.

In this embodiment, the magnesium wire is removed based on a difference in chemical property between the aluminium alloy and the magnesium so as to form the micro-hole. For example, the aluminium alloy composite profile with the magnesium wire embedded therein may be immersed in a bicarbonate (such as sodium bicarbonate) or ammonium chloride solution to perform a chemical reaction between the magnesium (chemically active) and the bicarbonate or ammonium chloride, which enables the magnesium wire to be removed from the aluminium alloy composite profile without changing the matrix thereof and thus a micro-hole of a predetermined size and shape to be formed in a predetermined position in the aluminium alloy profile.

In yet another embodiment of the invention, the profile to be formed is a magnesium alloy profile, and the wire is an aluminum wire.

In this embodiment, the aluminum wire is removed based on a difference in chemical property between the magnesium alloy and the aluminium so as to form the micro-hole. For example, the magnesium alloy composite profile with the aluminium wire embedded therein may be immersed in a hydrofluoric acid or caustic alkali (such as caustic soda or potash) solution to perform a chemical reaction between the aluminium and the hydrofluoric acid or caustic alkali, which enables the aluminium wire to be removed from the magnesium alloy composite profile without changing the matrix thereof and thus a micro-hole of a predetermined size and shape to be formed in a predetermined position in the magnesium alloy profile.

The method of the invention may further comprise after step (ii): cleaning the micro-hole, preferably rinsing the micro-hole using high pressure gas or liquid.

A second aspect of the invention is a profile made by the method according to the first aspect of the invention, characterized by a micro-hole therein that:

(1) can be continuous and have a hole size smaller than 3 millimetres;

(2) can have a cross section, the shape and size of which is continuously varied;

(3) can be a continuous deep micro-hole in a thin wall of the profile, which is difficult to be formed by other known methods; and (4) can be infinitely long and continuous.

According to the invention, the predetermined shape, size and position as well as accuracy of the micro-hole formed in the profile can be preliminarily ensured by the wire embedded in the profile, and can also be further optimized by using existing methods. The continuous variation in the shape and size of the micro-hole in the profile can be enabled by adjusting shapes and sizes of different sections of the wire, and the position of the micro-hole in the profile can be varied by adjusting the position of an inlet of the wire in the composite extrusion die.

A third aspect of the invention is a use of the profile according to the second aspect of the invention in aerospace, vehicle machinery, or optoelectronic instruments.

The present invention has several advantages.

According to the method of the invention, unlike conventional methods for machining micro-holes, a wire is introduced into the profile during forming thereof, and then removed therefrom without changing the matrix thereof based on a difference in physical or chemical properties between the wire and the matrix of the profile so as to form a micro-hole in the profile. As compared with the conventional methods for forming micro-holes in a profile, the method of the invention is simple, does not require any large and expensive equipment, and can produce continuous micro-holes of different specifications. Thus, the method of the invention has very good prospect of industrial application.

DETAILED DESCRIPTION

It is noted that the following detailed description is exemplary and intended to provide further explanation. Unless otherwise defined, all technical and scientific terms used herein have the same meaning as commonly understood by those of skill in the art of the invention.

It should be noted that the terms used herein are provided to describe particular embodiments only and are not intended to limit the exemplary embodiments of the invention. The expression in the singular form in this specification will cover the expression in the plural form unless otherwise indicated. In addition, it is to be understood that the term "comprise" and its variations when used in this specification, specify the presence of stated features, steps, operations, devices, components, and/or combination thereof.

As indicated in the background, the prior art methods for machining micro-holes in a profile usually require sophisticated and expensive equipment, and it is often difficult for them to form deep micro-holes with small hole sizes because they are limited by machine tools, accuracy of the methods themselves, depths of the micro-holes, cross section sizes, and machining accuracy.

In view of the above, a typical embodiment of the invention disclosed in the description is a method for making a profile with a micro-hole, comprising embedding, in a position in a matrix of the profile to be formed by a continuous composite extrusion process where a micro-hole is to be formed, a continuous wire having a shape and size consistent with that of the micro-hole; performing extrusion to obtain a composite profile with the wire; and removing the wire from the obtained composite profile without changing the matrix thereof using a method which is performed based on a difference in physical or chemical properties between the wire and the matrix of the composite profile to obtain the profile with the micro-hole.

In a particular embodiment, the method comprises:

i. performing a continuous composite extrusion process by using a composite extrusion die to form a composite profile, wherein in a position in a matrix of the profile to be formed where a micro-hole is to be formed, a continuous wire having a shape and size consistent with that of the micro-hole is embedded; and ii. cutting the composite profile to a desired length; and removing the wire from the cut composite profile without changing the matrix thereof using a method which is performed based on a difference in physical or chemical properties between the wire and the matrix of the composite profile to obtain the profile with the micro-hole.

There must be one or more different physical or chemical properties between the wire and the matrix of the composite profile, which enable the wire to be removed from the composite profile without changing the matrix thereof. The removal of the wire may be based on one preferred different physical or chemical property.

Accordingly, the removal of the wire from the composite profile is based on one or more different physical or chemical properties between the wire and the matirx of the composite profile, which may enable the wire to be changed into gas and/or a soluble solid and the matrix of the composite profile to remain unchanged such that the wire can be removed from the composite profile.

Some embodiments of the method according to the invention are provided below.

In an embodiment, the profile to be formed is a titanium alloy profile, and the wire used is a composite of glass fibre and nickel, or glass fibre and steel, or glass fibre and copper. In this embodiment, the titanium alloy composite profile is heated to soften the glass fibre therein and separate it from the matrix thereof so that the nickel, steel, or copper wire is removed from the titanium alloy composite profile and thus a micro-hole of a predetermined size and shape is formed in a predetermined position in the titanium alloy profile. This embodiment of the invention is based on the fact that the melting point of the titanium alloy profile is substantially greater than the softening point of the glass fibre in the glass fibre-nickel/steel/copper composite.

The glass fibre-nickel composite is preferably glass fibre wrapped nickel wire. Similarly, the glass fibre-steel composite is preferably glass fibre wrapped steel wire, and the glass fibre-copper composite is preferably glass fibre wrapped copper wire.

In the embodiment as described above, the composite profile is heated to a temperature which is equal to or higher than the softening point of the glass fibre and lower than the melting point of the titanium alloy.

In another embodiment, the profile to be formed is a magnesium alloy profile, and the wire used is an aluminum wire. In this embodiment, the aluminum wire is removed based on a difference in chemical property between the magnesium alloy and the aluminium to form the micro-hole. For example, the magnesium alloy composite profile with the aluminium wire embedded therein may be immersed in a hydrofluoric acid or caustic alkali (such as caustic soda or potash) solution to perform a chemical reaction between the aluminium and the hydrofluoric acid or caustic alkali, which enables the aluminium wire to be removed from the magnesium alloy composite profile without changing the matrix thereof and thus a micro-hole of a predetermined size and shape to be formed in a predetermined position in the magnesium alloy profile.

In yet another embodiment, the profile to be formed is an aluminium alloy profile, and the wire used is a magnesium wire. In this embodiment, the magnesium wire is removed based on a difference in chemical property between the aluminium alloy and the magnesium to form the micro-hole. For example, the aluminium alloy composite profile with the magnesium wire embedded therein may be immersed in a bicarbonate (such as sodium bicarbonate) or ammonium chloride solution to perform a chemical reaction between the magnesium (chemically active) and the bicarbonate or ammonium chloride, which enables the magnesium wire to be removed from the aluminium alloy composite profile without changing the matrix thereof and thus a micro-hole of a predetermined size and shape to be formed in a predetermined position in the aluminium alloy profile.

The wire may have a plurality of sections with different cross section shapes and sizes, and thus a continuous micro-hole with a plurality of sections having the different cross section shapes and sizes can be formed in the profile.

In an embodiment, the method of the invention further comprises after step (ii): cleaning the micro-hole, preferably using high pressure gas or liquid.

The invention further provides a profile made by the method as described above.

According to the invention, the predetermined shape, size and position as well as accuracy of the micro-hole formed in the profile can be preliminarily ensured by the wire embedded in the profile, and can also be further optimized by using known methods. The continuous variation in the shape and size of the micro-hole in the profile can be enabled by adjusting shapes and sizes of different sections of the wire, and the position of the micro-hole in the profile can be varied by adjusting the position of an inlet of the wire in the composite extrusion die.

The invention yet further provides a use of the profile as described above in aerospace, vehicle machinery, or opto-electronic instruments.

Examples will be provided below to further describe the invention, but not intended to limit the invention. It is to be understood that these examples are only illustrative and not intended to limit the scope of the invention. For the unspecified conditions in the examples, conventional conditions are generally used.

EXAMPLE 1

A continuous composite extrusion process was employed to make a titanium alloy profile with a micro-hole by using a composite extrusion die. In a position in a matrix of the profile to be formed where a micro-hole is to be formed, a glass fibre-nickel wire composite having a shape and size consistent with that of the micro-hole was embedded. Thereafter, extrusion was performed to obtain a titanium alloy composite profile with the glass fibre-nickel wire composite.

The composite profile was sawed to a desired length, and heated to a temperature equal to the softening point of the glass fibre and substantially lower than the melting point of the titanium alloy so that the glass fibre was softened and separated from the matrix of the titanium alloy composite profile and the nickel wire was thus removed from the composite profile. The micro-hole so formed was rinsed by high pressure liquid. A titanium alloy profile with a micro-hole was obtained. In this example, the glass fibre-nickel wire composite was glass fibre wrapped nickel wire with a diameter of 3 millimetres.

EXAMPLE 2

A continuous composite extrusion process was employed to make a magnesium alloy profile with a micro-hole by using a composite extrusion die. In a position in a matrix of the profile to be formed where a micro-hole is to be formed, an aluminum wire having a shape and size consistent with that of the micro-hole was embedded. Thereafter, extrusion was performed to obtain a magnesium alloy composite profile with the aluminum wire. The composite profile was sawed to a desired length, and immersed into a hydrofluoric acid solution to remove the aluminum wire from the composite profile. The micro-hole so formed was rinsed by high-pressure gas. A magnesium alloy profile with a micro-hole was obtained. In this example, the aluminum wire had a diameter of 1 millimetre.

EXAMPLE 3

A continuous composite extrusion process was employed to make a magnesium alloy profile with a micro-hole by using a composite extrusion die. In a position in a matrix of the profile to be formed where a micro-hole is to be formed, an aluminum wire having a shape and size consistent with that of the micro-hole was embedded. Thereafter, extrusion was performed to obtain a magnesium alloy composite profile with the aluminum wire. The composite profile was sawed to a desired length, and immersed into a caustic soda solution to remove the aluminum wire from the composite profile. The micro-hole so formed was rinsed using high-pressure liquid. A magnesium alloy profile with a micro-hole was obtained. In this example, the aluminum wire had a diameter of 1.5 millimetres.

EXAMPLE 4

A continuous composite extrusion process was employed to make an aluminum alloy profile with a micro-hole by using a composite extrusion die. In a position in a matrix of the profile to be formed where a micro-hole is to be formed, a magnesium wire having a shape and size consistent with that of the micro-hole was embedded. Thereafter, extrusion was performed to obtain an aluminum alloy composite profile with the magnesium wire. The composite profile was sawed to a desired length, and immersed into an ammonium chloride solution to remove the magnesium wire from the composite profile. The micro-hole so formed was rinsed using high-pressure liquid. An aluminum alloy profile with a micro-hole was obtained. In this example, the magnesium wire had a diameter of 2 millimetres.

EXAMPLE 5

A continuous composite extrusion process was employed to make an aluminum alloy profile with a micro-hole by using a composite extrusion die. In a position in a composite of the profile to be formed where a micro-hole is to be formed, a magnesium wire having a shape and size consistent with that of the micro-hole was embedded. Thereafter, extrusion was performed to obtain an aluminum alloy composite profile with the magnesium wire. The composite profile was sawed to a desired length, and immersed into a sodium bicarbonate solution to remove the magnesium wire from the composite profile. The micro-hole so formed was rinsed using high-pressure liquid. An aluminum alloy profile with a micro-hole was obtained. In this example, the magnesium wire had a diameter of 0.5 millimetres.

It should be noted that the embodiments above are for the purpose of illustration only and not to limit the scope of the invention. Although the invention has been described above with reference to the embodiments of the invention, it is apparent for those of skill in the art that modifications and equivalent substitutions can be made without departing from the spirit and scope of the invention.

What is claimed is:

1. A method for making a profile with a micro-hole, comprising:

embedding, in a position in a matrix of a profile to be formed by a continuous composite extrusion process where a micro-hole is to be formed, a continuous wire having a shape and size consistent with that of the micro-hole;

performing extrusion to obtain a composite profile with the wire; and removing the wire from the obtained composite profile without changing the matrix of the composite profile using a process which is performed based on a difference in physical or chemical properties between the wire and the matrix of the composite profile to obtain the profile with the micro-hole;

wherein, the profile to be formed is an aluminum alloy profile, and the wire is a magnesium wire;

wherein, the magnesium wire is removed based on a difference in reactivity between the aluminum alloy and the magnesium so as to form the micro-hole; and wherein, the aluminum alloy composite profile with the magnesium wire embedded therein is immersed in a sodium bicarbonate or ammonium chloride solution to remove the magnesium wire from the aluminum alloy composite profile without changing the matrix thereof and thus the micro-hole is formed therein.

2. The method according to claim 1, wherein, the method comprises steps of:

i. performing the continuous composite extrusion process by using a composite extrusion die to form the composite profile, wherein in the position in the matrix of the profile to be formed where the micro-hole is to be formed, the continuous wire having a shape and size consistent with that of the micro-hole is embedded; and ii. cutting the composite profile to a desired length; and removing the wire from the cut composite profile without changing the matrix of the composite profile using the process a which is performed based on the difference in physical or chemical properties between the wire and the matrix of the composite profile to obtain the profile with the micro-hole.

3. The method according to claim 2, wherein, there is one or more different chemical or physical properties between the wire and the matrix of the composite profile, which enable the wire to be removed from the composite profile without changing the matrix thereof.

4. A method for making a profile with a micro-hole comprising:

embedding, in a position in a matrix of a profile to be formed by a continuous composite extrusion process where a micro-hole is to be formed, a continuous wire having a shape and size consistent with that of the micro-hole;

performing extrusion to obtain a composite profile with the wire; and removing the wire from the obtained composite profile without changing the matrix of the composite profile using a process which is performed based on a difference in physical or chemical properties between the wire and the matrix of the composite profile to obtain the profile with the micro-hole;

wherein, the profile to be formed is a titanium alloy profile, and the wire is a composite of glass fibre and nickel, or glass fibre and steel, or glass fibre and copper;

wherein, the composite profile is heated to soften the glass fibre therein and separate a resulting softened glass fibre from the matrix thereof so that the nickel, steel, or copper wire is removed from the titanium alloy composite profile and thus the micro-hole is formed therein; and wherein, the glass fibre-nickel composite is glass fibre wrapped nickel wire, the glass fibre-steel composite is glass fibre wrapped steel wire, and the glass fibre-copper composite is glass fibre wrapped copper wire.

5. A method for making a profile with a micro-hole comprising:

embedding, in a position in a matrix of a profile to be formed by a continuous composite extrusion process where a micro-hole is to be formed, a continuous wire having a shape and size consistent with that of the micro-hole;

performing extrusion to obtain a composite profile with the wire; and removing the wire from the obtained composite profile without changing the matrix of the composite profile using a process which is performed based on a difference in physical or chemical properties between the wire and the matrix of the composite profile to obtain the profile with the micro-hole;

wherein, the profile to be formed is a magnesium alloy profile, and the wire is an aluminum wire; wherein, the aluminum wire is removed based on a difference in chemical property between the magnesium alloy and the aluminum so as to form the micro-hole; and wherein, the magnesium alloy composite profile with the aluminum wire embedded therein is immersed in a hydrofluoric acid or caustic soda or potash solution to remove the aluminum wire from the magnesium alloy composite profile without changing the matrix thereof and thus the micro-hole is formed therein.

6. The method according to claim 1, wherein, the wire has a plurality of sections with different cross section shapes and sizes.

7. The method according to claim 2, further comprising after the step (ii): cleaning the micro-hole, wherein the cleaning is conducted by rinsing the micro-hole using high pressure gas or liquid.

* * * * *